US011326329B2

(12) United States Patent
Brooks

(10) Patent No.: US 11,326,329 B2
(45) Date of Patent: May 10, 2022

(54) ACCESSORY, SYSTEM, AND METHOD FOR HOLDING AN UNDERMOUNT SINK AGAINST THE UNDERSIDE OF AN OPENING OF A COUNTERTOP

(71) Applicant: Ryan Brooks, Concord, NC (US)

(72) Inventor: Ryan Brooks, Concord, NC (US)

( * ) Notice: Subject to any disclaimer, the term of this patent is extended or adjusted under 35 U.S.C. 154(b) by 0 days.

(21) Appl. No.: 17/215,298

(22) Filed: Mar. 29, 2021

(65) Prior Publication Data

US 2021/0372107 A1 Dec. 2, 2021

Related U.S. Application Data

(60) Provisional application No. 63/031,283, filed on May 28, 2020.

(51) Int. Cl.
*E03C 1/33* (2006.01)

(52) U.S. Cl.
CPC ..... *E03C 1/33* (2013.01)

(58) Field of Classification Search
CPC ..... E03C 1/33
USPC ..... 4/647, 654
See application file for complete search history.

(56) References Cited

U.S. PATENT DOCUMENTS 8,070,562 B1 * 12/2011 Murrer ..... E03C 1/33 451/365
2020/0180120 A1 * 6/2020 Kosik, Sr. ..... E03C 1/33

* cited by examiner

*Primary Examiner* — Christine J Skubinna
(74) *Attorney, Agent, or Firm* — Jeffrey C. Watson; Grell & Watson Patent Attorneys LLC

(57) ABSTRACT

An accessory, system and method for holding an undermount sink with a drain hole against an underside of an opening of a countertop includes a plank, a cord, and a block. The plank has a first length that is longer than an opening width of the opening in the countertop. The cord has a top end and a bottom end. The top end of the cord is attached to the plank. The block is affixed to the bottom end of the cord. The block is configured to be inserted into and secured under the drain hole. The block has a second length longer than a drain width of the drain hole. The accessory is configured for holding the undermount sink against the underside of the opening of the countertop through the cord being attached between the plank and the block.

20 Claims, 11 Drawing Sheets

ACCESSORY, SYSTEM, AND METHOD FOR HOLDING AN UNDERMOUNT SINK AGAINST THE UNDERSIDE OF AN OPENING OF A COUNTERTOP

CROSS-REFERENCE TO RELATED APPLICATIONS

This application claims benefit of priority application, U.S. Provisional Ser. No. 63/031,283 filed May 28, 2020 entitled "Accessory for Lifting and Securely Holding an Undermount Sink Against the Underside of a Granite Countertop", which is incorporated herein by reference in its entirety.

FIELD OF THE DISCLOSURE

The present disclosure is related to undermount sinks and installation thereof. More specifically, the instant disclosure is directed toward an accessory, system, and method for holding an undermount sink against the underside of an opening of a countertop, like a granite countertop.

BACKGROUND

Generally speaking, a sink, also known by other names including sinker, washbowl, hand basin, wash basin, and simply basin, is a bowl-shaped plumbing fixture used for washing hands, dishwashing, and other purposes. Sinks have taps (faucets) that supply hot and cold water and may include a spray feature to be used for faster rinsing. Sinks may also include a drain to remove used water. Some drains may include a strainer and/or shut-off device and an overflow-prevention device. Sinks may also have an integrated soap dispenser and/or garbage disposal. Many sinks, especially in kitchens, are installed adjacent to or inside a counter.

An undermount sink, also known as a bottom-mount sink, is a sink that is installed below the countertop surface. The edge of the countertop material is exposed at the hole created for the sink, and so must be a carefully finished edge rather than a rough cut. The sink is then clamped to the bottom of the material from below. Especially for bottom-mount sinks, silicone-based sealants are usually used to assure a waterproof joint between the sink and the countertop material. Advantages of an undermount sink include superior ergonomics and a contemporary look. Disadvantages include extra cost in both the sink and the counter top. Also, no matter how carefully the cut out is made; the result is either a small ledge or overhang at the interface with the sink. This can create an environment for catching dirt and allowing germs to grow.

The instant disclosure recognizes the difficulty in installing an undermount sink. More specifically, the instant disclosure recognizes the need for two (2) or more people to install an undermount sink. Due to the weight and size or bulk of sinks, multiple installers are typically required to aid in positioning the sink in the proper position below the hole in the countertop where it can be held in place. This may be especially true for larger double sinks and/or farm sinks. Therefore, a need exists for a device and/or method that aids in installing an undermount sink that may allow for easier installation and/or by installation by only a single installer.

The instant disclosure may be designed to address at least certain aspects of the problems or needs discussed above by providing an accessory, system, and method for holding an undermount sink against an underside of an opening of a countertop.

SUMMARY

The present disclosure may solve the aforementioned limitations of the currently available devices, tools, systems, and/or methods for installing undermount sinks by providing the disclosed accessory, system and/or method. Generally speaking, the accessory for holding an undermount sink with a drain hole against an underside of an opening of a countertop may include a plank, a cord, and a block. The plank may have a first length that is longer than an opening width of the opening in the countertop. The cord may have a top end and a bottom end. The top end of the cord may be attached to the plank. The block may be affixed to the bottom end of the cord. The block may be configured to be inserted into and secured under the drain hole. The block may have a second length longer than a drain width of the drain hole. The accessory may be configured for holding the undermount sink against the underside of the opening of the countertop through the cord being attached between the plank and the block. Whereby, when the block is positioned below the drain hole of the undermount sink across the drain width of the drain hole and the plank is positioned across the opening width of the opening in the countertop, the cord may be configured to extend from the plank to the block, whereby the accessory may be configured to support the undermount sink against the underside of the opening of the countertop.

One feature of the disclosed accessory for holding an undermount sink with a drain hole against an underside of an opening of a countertop may be that the cord can have an adjustable length. The adjustable length of the cord may be configured for allowing the accessory to be used with various sizes, shapes, or configurations of the undermount sink. The adjustable length of the cord may also be configured for lengthening to allow for the plank to be positioned across the opening width of the opening of the countertop and the block to be positioned below the drain hole across the drain width of the drain hole, whereby, the cord may be configured to shorten for tensioning the cord between the plank positioned across the opening of the countertop and the block positioned below the drain hole across the drain width of the drain hole. In select embodiments, the adjustable length of the cord may include an adjustment mechanism configured for adjusting the adjustable length of the cord. The adjustment mechanism may include any adjustment type of mechanism for the cord, including but not limited to, a slip coupling configured to allow the adjustable length of the cord to be adjusted and secured in length.

In select embodiments of the disclosed accessory for holding an undermount sink with a drain hole against an underside of an opening of a countertop, the adjustment mechanism for the cord may include an L-shaped bracket. The L-shaped bracket may have a vertical portion and a horizontal portion. The vertical portion may include at least three holes therethrough. The three holes through the vertical portion may include a first hole, a second hole and a third hole. The first hole may be configured to hold a first end of the cord. The second hole may be below the first hole and may be configured to receive the cord therethrough. The third hole may be below the second hole and may be configured to receive the cord therethrough. Wherein, the cord may be secured to the first hole at the first end via a first knot, wrap around the plank in an adjustable loop and go through the second hole in one direction, back through the third hole in another direction, and be secured to the block at a second end. Wherein, the L-shaped bracket may be moved up and down on the cord through the second hole and the third hole. Whereby the adjustable loop around the plank may be increased and decreased for shortening and lengthening the cord, respectively. The horizontal portion of the L-shaped bracket may be configured for manipulating the L-shaped bracket to move up and down on the cord. Wherein the L-shaped bracket may be locked into position on the cord when tensioned via the cord going through the second hole in the one direction and back through the third hole in the another direction, thereby locking the adjustable length of the cord.

In select embodiments of the disclosed accessory for holding an undermount sink with a drain hole against an underside of an opening of a countertop, the block may include a block hole therethrough configured to receive a second end of the cord. Whereby, a second knot may be tied below the block for securing the second end of the cord to the block.

Another feature of the disclosed accessory for holding an undermount sink with a drain hole against an underside of an opening of a countertop may be that the block can include a bottom portion and a top portion. The bottom portion may have a bottom length, where the bottom length is the second length that is longer than the drain width of the drain hole. The top portion may have a top length, where the top length may be shorter than the drain width of the drain hole. Wherein, the block may be configured to securely hold the undermount sink via the drain hole by inserting the top portion inside the drain width of the drain hole, where the bottom portion extends across the drain width of the drain hole. Whereby, the top portion positioned inside the drain width of the drain hole may be configured to maintain the position of the bottom portion across the drain width of the drain hole.

Another feature of the disclosed accessory for holding an undermount sink with a drain hole against an underside of an opening of a countertop may be that the plank can include a height and a width. The width may be larger or longer than the height. Wherein, the plank may be configured to tension the cord for securely holding the undermount sink in position under the opening in the countertop by rotating the plank from a first position where the height is vertical to a second tensioned position where the width is vertical.

Another feature of the disclosed accessory for holding an undermount sink with a drain hole against an underside of an opening of a countertop may be that the plank can include a slot running lengthwise therethrough. Wherein, the cord may be wrapped around the plank through the slot to create an adjustable loop. Whereby, the slot may be configured to maintain the adjustable loop on the plank while allowing the adjustable loop to move lengthwise along the plank for proper positioning over the drain hole of the undermount sink.

Another feature of the disclosed accessory for holding an undermount sink with a drain hole against an underside of an opening of a countertop may be that the accessory can be used on any type of countertop, including, but not limited to a granite countertop, or the like.

In another aspect, the instant disclosure embraces an accessory system for holding a double undermount sink with two drain holes against an underside of a double sized opening of a countertop. In general, the disclosed accessory system may include two or more of the accessories for holding an undermount sink with a drain hole against an underside of an opening of a countertop in any of the various embodiments and/or combination of embodiments shown and/or described herein. Accordingly, the disclosed accessory system may include a first accessory and a second accessory. The first accessory may include a first plank, a first cord, and a first block. The first plank may have a first length longer than an opening width of the double sized opening in the countertop. The first cord may have a first top end and a first bottom end. The first top end of the first cord may be attached to the first plank. The first block may be affixed to the first bottom end of the first cord. The first block may be configured to be inserted into and secured under one drain hole of the two drain holes. The first block may have a second length longer than a drain width of the one drain hole of the two drain holes. The second accessory may include a second plank, a second cord, and a second block. The second plank may have the first length longer than the opening width of the double sized opening in the countertop. The second cord may have a second top end and a second bottom end. The second top end of the second cord may be attached to the second plank. The second block may be affixed to the second bottom end of the second cord. The second block may be configured to be inserted into and secured under another drain hole of the two drain holes. The second block may have the second length longer than a drain width of the another drain hole of the two drain holes. Wherein, the accessory system may be configured for holding the double undermount sink against the underside of the double sized opening of the countertop through the first cord being attached between the first plank and the first block and the second cord being attached between the second plank and the second block. Whereby, when the first block is positioned below the one drain hole of the two drain holes of the double undermount sink across the drain width of the one drain hole of the two drain holes and the first plank is positioned across the opening width of the double sized opening in the countertop, the first cord may be configured to extend from the first plank to the first block. Likewise, when the second block is positioned below the another drain hole of the two drain holes of the double undermount sink across the drain width of the another drain hole of the two drain holes and the second plank is positioned across the opening width of the double sized opening in the countertop, the second cord may be configured to extend from the second plank to the second block. Whereby the accessory system may be configured to support the double undermount sink against the underside of the double sized opening of the countertop via the first accessory and the second accessory.

One feature of the disclosed accessory system for holding a double undermount sink with two drain holes against an underside of a double sized opening of a countertop may be that the first cord and the second cord may have adjustable lengths. The adjustable lengths of the first cord and the second cord may be configured for use with various sizes, shapes, or configurations of the double undermount sink. The adjustable lengths of the first cord and the second cord may also be configured for lengthening to allow for the first plank and the second plank to be positioned across the opening width of the double sized opening of the countertop, and the first block to be positioned below the one drain hole of the two drain holes across the drain width and the second block to be positioned below the another drain hole of the two drain holes across the drain width. Whereby, the first cord and the second cord may be configured to shorten for tensioning the first cord and the second cord between the first plank and the second plank positioned across the double sized opening of the countertop and the first block and the second block positioned below the two drain holes. In select embodiments, the adjustable length of each of the first cord and the second cord may include an adjustment mechanism configured for adjusting the adjustable length of each of the first cord and the second cord. The adjustment mechanism of the first cord and the second cord may be any adjustment mechanism, including, but not limited to, any of the embodiments of the adjustment mechanisms shown and/or described herein.

Another feature of the disclosed accessory system for holding a double undermount sink with two drain holes against an underside of a double sized opening of a countertop may be that the first block can include a first bottom portion and a first top portion. The first bottom portion may include a bottom length, where the bottom length is the second length that is longer than the drain width of the two drain holes. The first top portion may have a top length, where the top length is shorter than the drain width of the two drain holes. Wherein, the first block may be configured to securely hold the double undermount sink via the one drain hole of the two drain holes by inserting the first top portion inside the drain width of the one drain hole of the two drain holes, where the first bottom portion extends across the drain width of the one drain hole of the two drain holes. Whereby, the first top portion positioned inside the drain width of the one drain hole of the two drain holes may be configured to maintain the position of the first bottom portion across the drain width of the one drain hole of the two drain holes.

Another feature of the disclosed accessory system for holding a double undermount sink with two drain holes against an underside of a double sized opening of a countertop may be that the second block can include a second bottom portion and a second top portion. The second bottom portion may include a bottom length, where the bottom length is the second length that is longer than the drain width of the two drain holes. The second top portion may have a top length, where the top length is shorter than the drain width of the two drain holes. Wherein, the second block may be configured to securely hold the double undermount sink via the another drain hole of the two drain holes by inserting the second top portion inside the drain width of the another drain hole of the two drain holes, where the second bottom portion extends across the drain width of the another drain hole of the two drain holes. Whereby, the second top portion positioned inside the drain width of the another drain hole of the two drain holes may be configured to maintain the position of the second bottom portion across the drain width of the another drain hole of the two drain holes.

Another feature of the disclosed accessory system for holding a double undermount sink with two drain holes against an underside of a double sized opening of a countertop may be that the first plank and the second plank can include a height and a width. The width of the first plank and the second plank may be larger than the height. Wherein, the first plank and the second plank may be configured to tension the first cord and the second cord, respectively, for securely holding the double undermount sink in position under the double sized opening in the countertop by rotating the first plank and the second plank from a first position where the height is vertical to a second tensioned position where the width is vertical.

Another feature of the disclosed accessory system for holding a double undermount sink with two drain holes against an underside of a double sized opening of a countertop may be that the first plank can include a first slot. The first slot may run lengthwise therethrough, wherein the first cord may be wrapped around the first plank through the first slot to create a first adjustable loop. Wherein the first slot may be configured to maintain the first adjustable loop on the first plank while allowing the first adjustable loop to move lengthwise along the first plank for proper positioning over the one drain hole of the two drain holes of the double undermount sink.

Another feature of the disclosed accessory system for holding a double undermount sink with two drain holes against an underside of a double sized opening of a countertop may be that the second plank can include a second slot. The second slot may run lengthwise therethrough, wherein the second cord may be wrapped around the second plank through the second slot to create a second adjustable loop. Wherein the second slot may be configured to maintain the second adjustable loop on the second plank while allowing the second adjustable loop to move lengthwise along the second plank for proper positioning over the another drain hole of the two drain holes of the double undermount sink.

In another aspect, the instant disclosure embraces a method of installing an undermount sink (or a double undermount sink) with a drain hole (or two drain holes). The disclosed method of installing an undermount sink (or a double undermount sink) with a drain hole (or two drain holes) may generally include utilizing the accessory (or accessory system) for holding an undermount sink with a drain hole against an underside of an opening of a countertop in any of the embodiments and/or combination of embodiments shown and/or described herein. As such, the disclosed method of installing an undermount sink (or a double undermount sink) with a drain hole (or two drain holes) may include providing at least one accessory for holding the undermount sink against an underside of an opening of a countertop in any of the embodiments and/or combination of embodiments shown and/or described herein. With the provided accessory or accessories, the method may further include the steps of: positioning the undermount sink below the opening in the countertop; inserting the block into the drain hole and positioning the block across the drain width below the drain hole; placing the plank across the opening width of the opening in the countertop; and supporting (or holding) the undermount sink against the underside of the opening of the countertop by way of the block being attached to the plank via the cord.

In select embodiments of the disclosed method of installing an undermount sink (or a double undermount sink) with a drain hole (or two drain holes), when the cord has an adjustable length, the method further including the steps of: prior to inserting the block into the drain hole, lengthening the cord to allow for the plank to be positioned across the opening width of the opening of the countertop, and the block to be positioned below the drain hole across the drain width of the drain hole; after the plank is placed across the opening width of the opening of the countertop, shortening the cord for tensioning the cord between the plank positioned across the opening of the countertop and the block positioned below the drain hole across the drain width of the drain hole; and rotating the plank from a first position to a tensioned second position for further tensioning the cord between the plank and the block.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
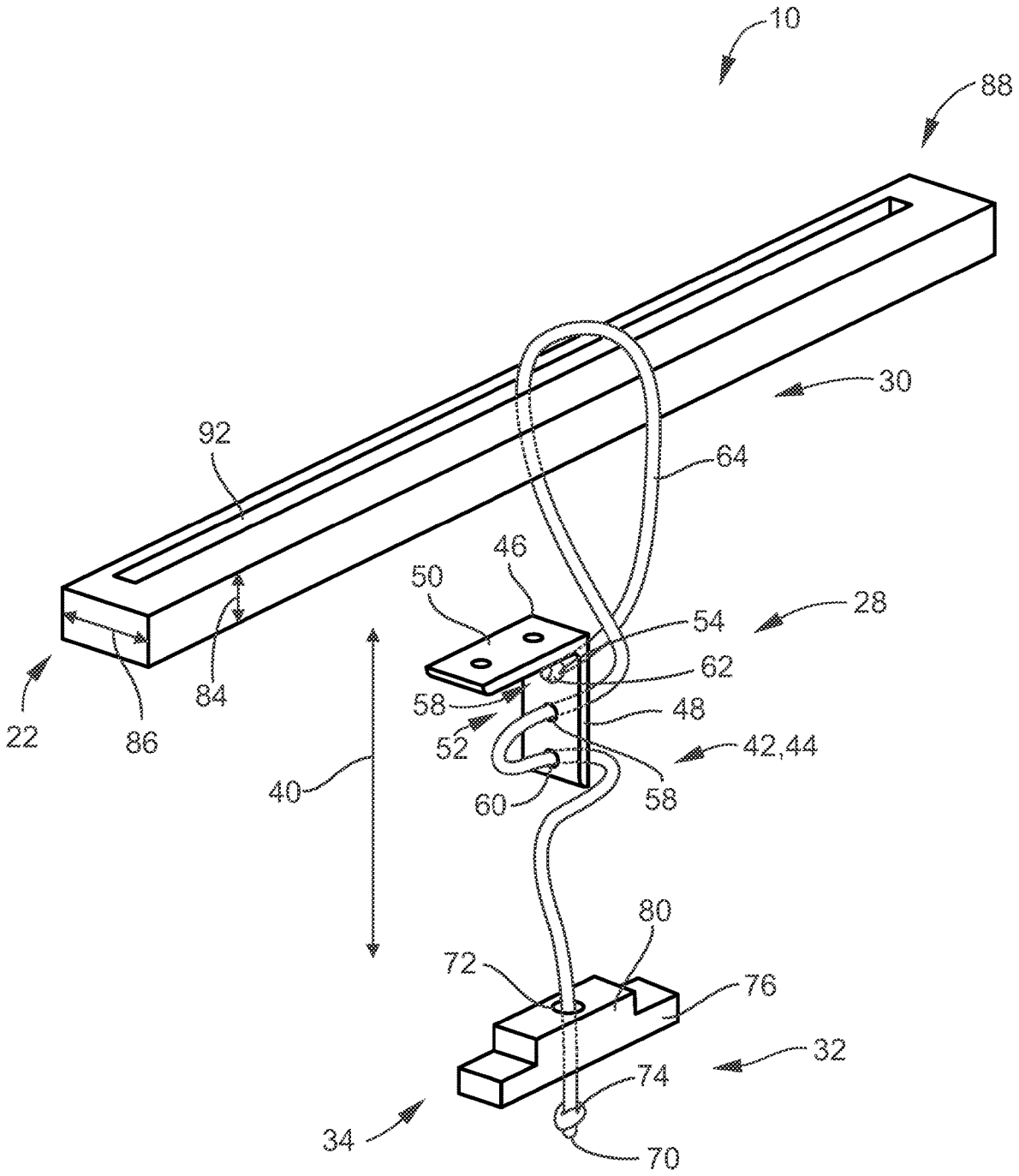
FIG. 1 is a perspective view of an accessory for holding an undermount sink against an underside of an opening of a countertop according to select embodiments of the instant disclosure.
Figure 2:
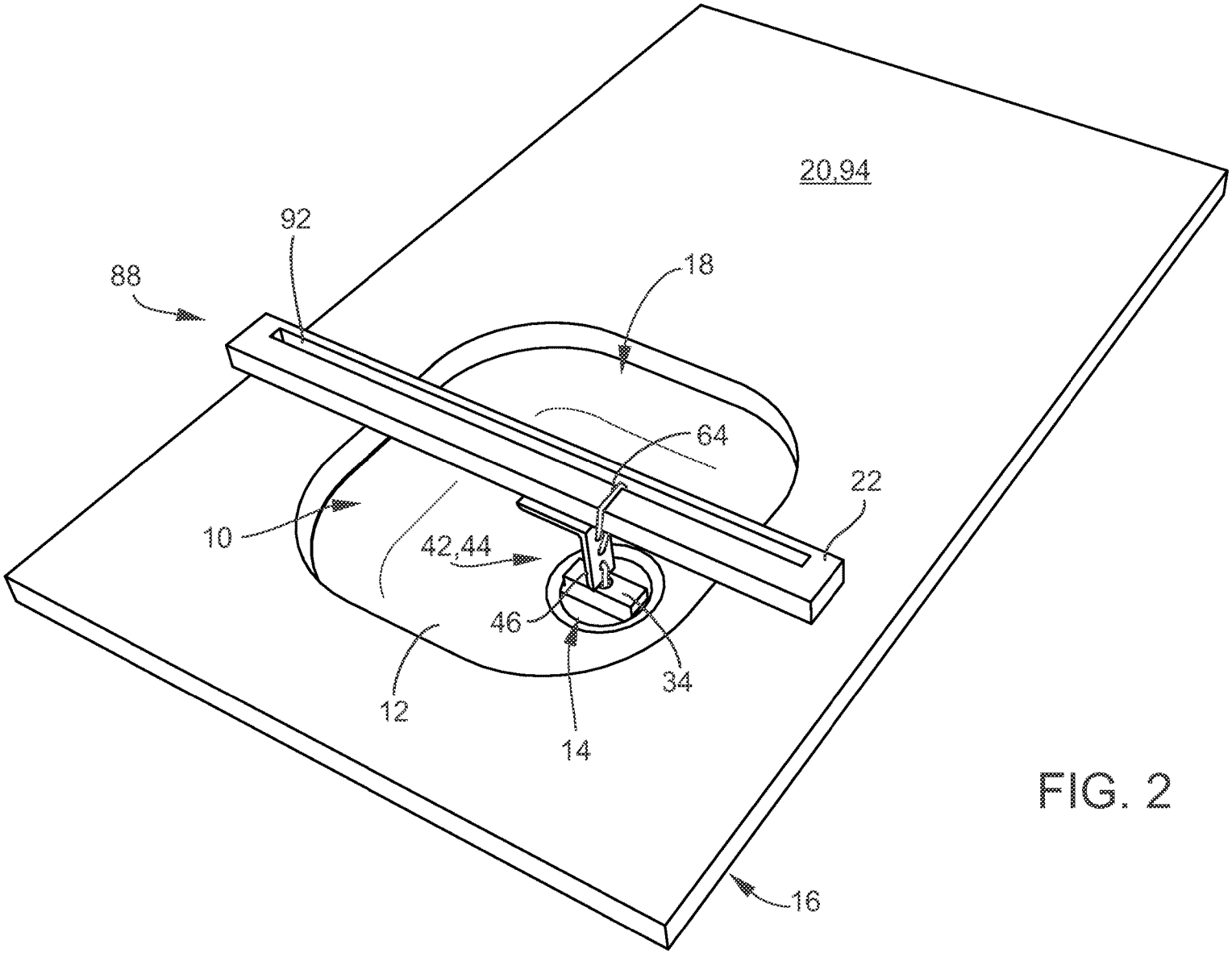
FIG. 2 is a top perspective environmental view of the accessory for holding an undermount sink against an underside of an opening of a countertop of FIG. 1 being used to hold the undermount sink in position on the underside of an opening of a countertop.
Figure 3:
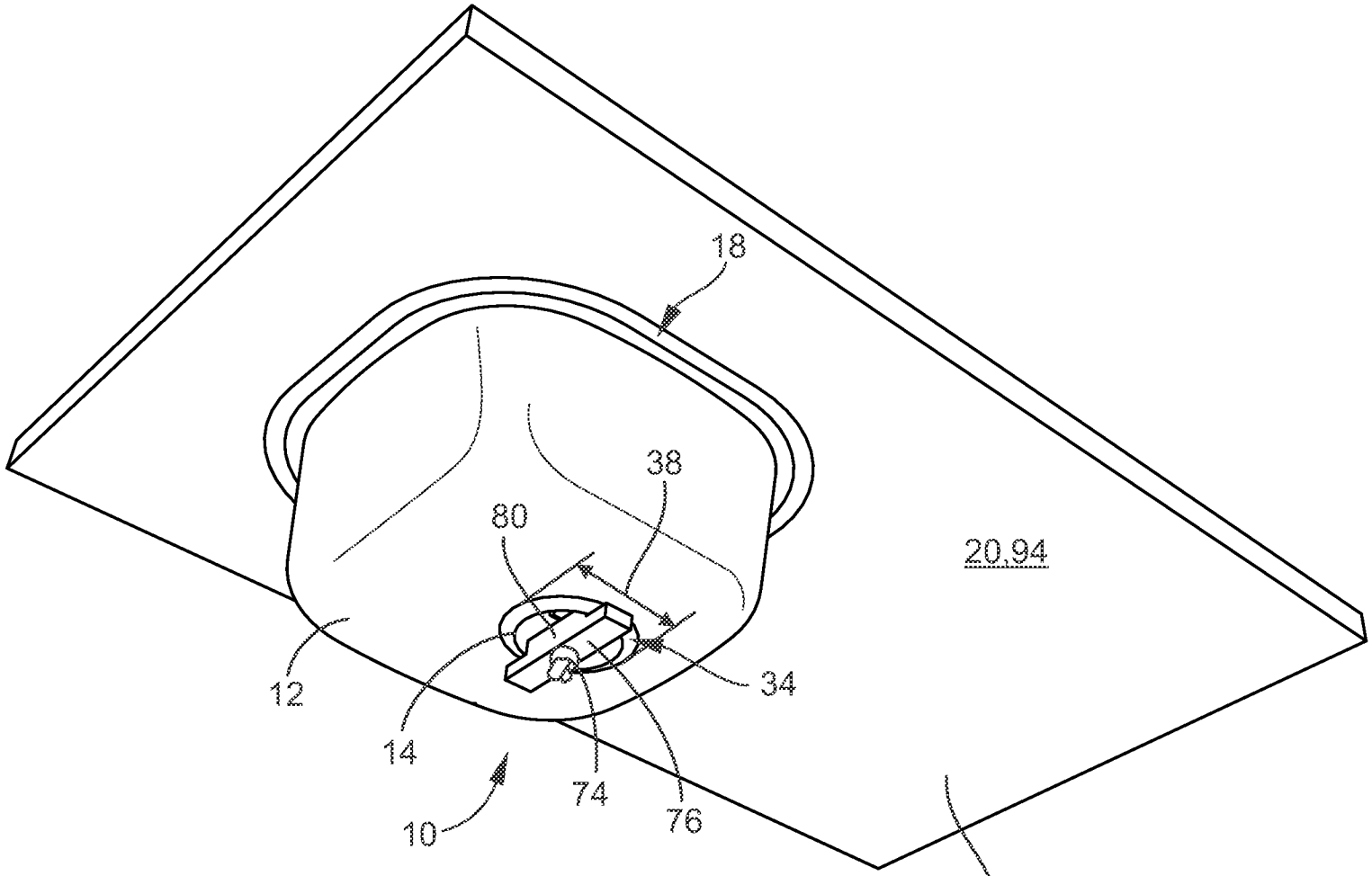
FIG. 3 is a bottom perspective environmental view of the accessory for holding an undermount sink against an underside of an opening of a countertop of FIG. 1 being used to hold the undermount sink in position on the underside of an opening of a countertop.
Figure 4A:
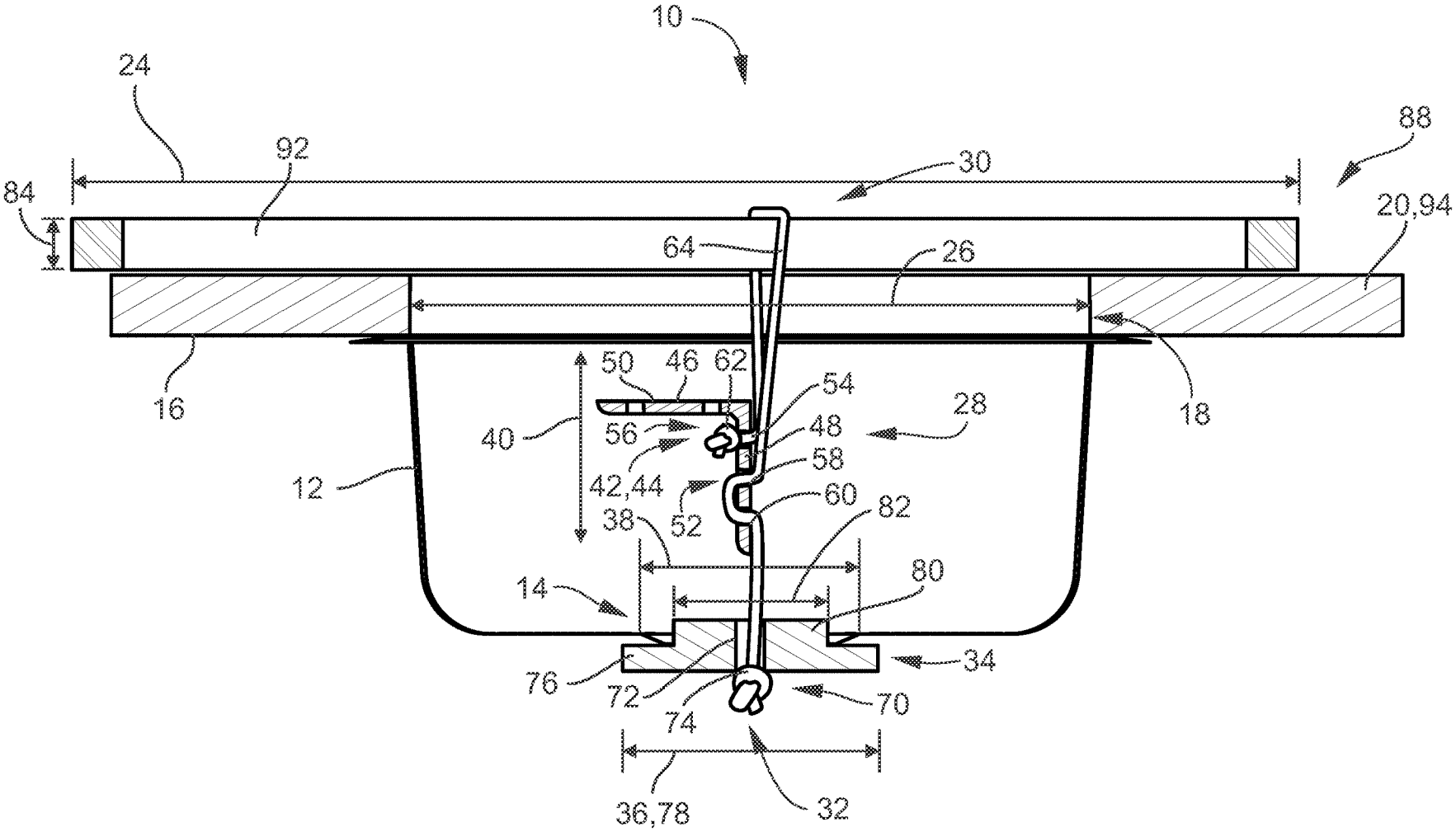
FIG. 4A is a cross-sectional view of the accessory for holding an undermount sink against an underside of an opening of a countertop of FIG. 1 being used to hold the undermount sink in position on the underside of an opening of a countertop.
Figure 4B:
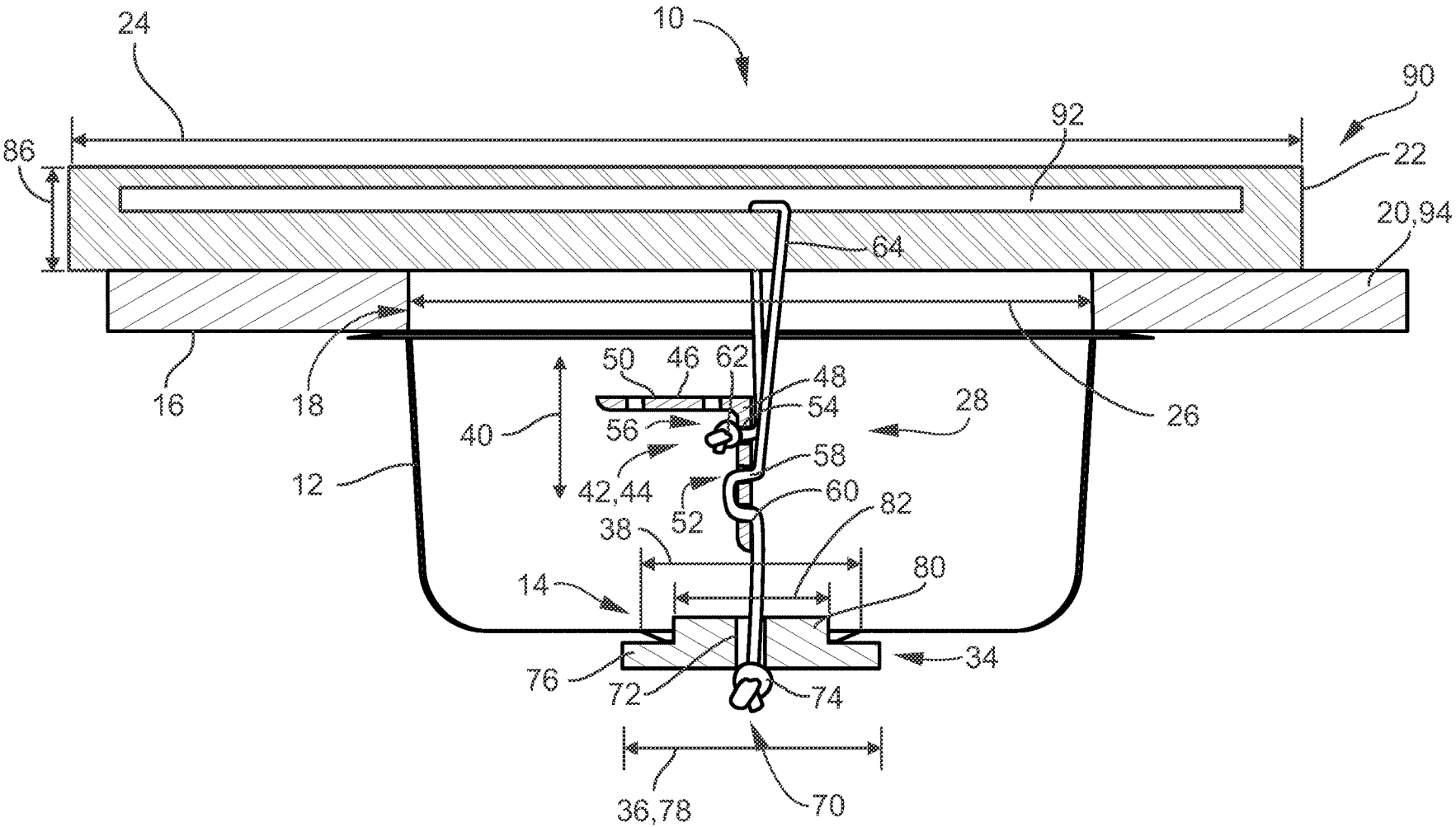
FIG. 4B is a cross-sectional view of the accessory for holding an undermount sink against an underside of an opening of a countertop of FIG. 1 being used to hold the undermount sink in position on the underside of an opening of a countertop with the plank rotated vertically to create tension.
Figure 5:
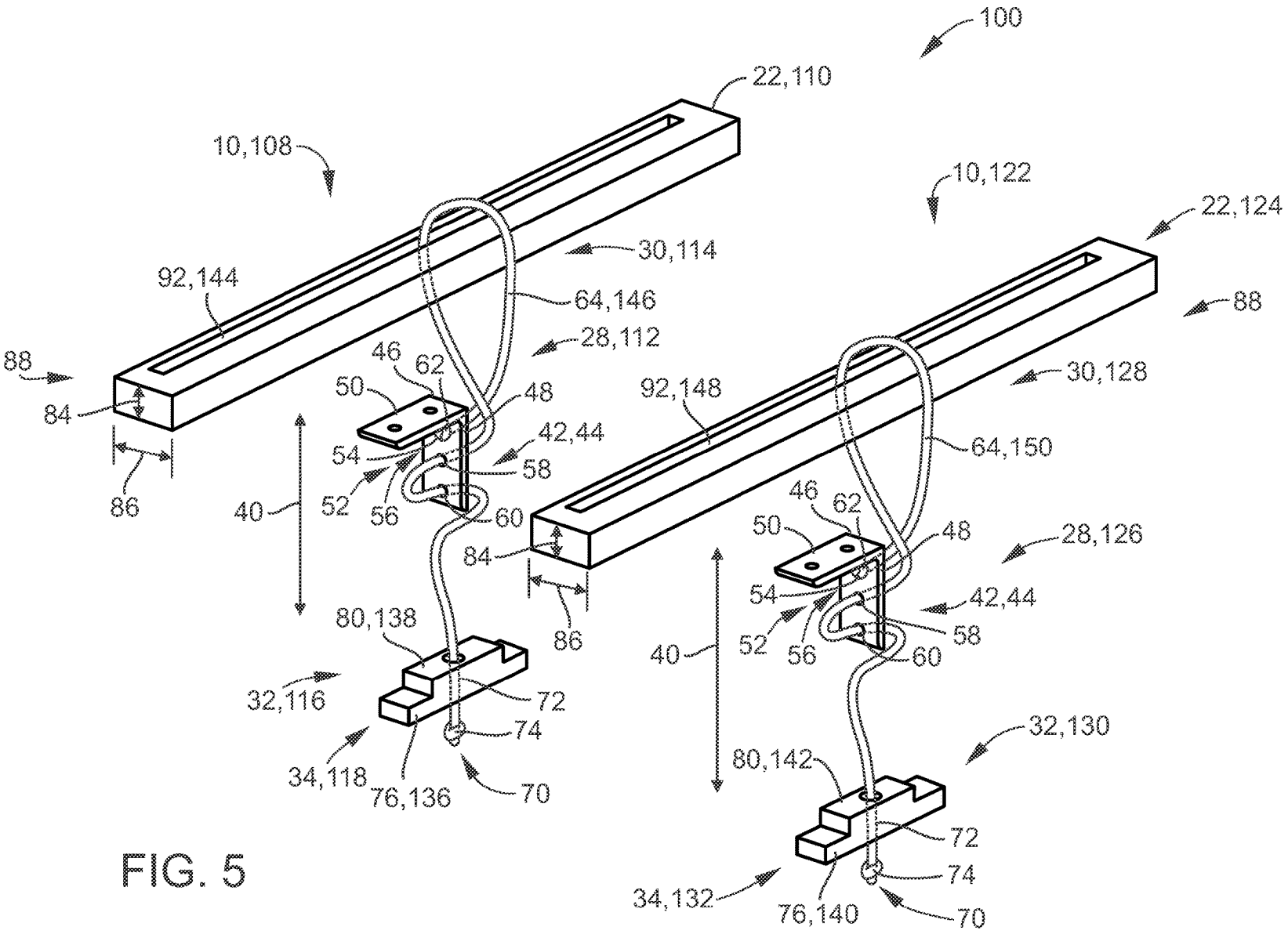
FIG. 5 is a perspective view of the system with two (2) accessories for holding an undermount sink against an underside of an opening of a countertop according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-10, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples. The present disclosure solves the aforementioned limitations of the currently available devices and methods of the currently available devices, tools, systems, and/or methods for installing undermount sinks by providing the disclosed accessory 10 (see FIGS. 1-9), system 100 (see FIGS. 6-9) and/or method 200 (see FIG. 10). Accessory 10, system 100 and/or method 200 may be utilized to help install a sink, like an undermount sink (undermount sink 12 and/or double undermount sink 102) prior to a plumber installing the drain and/or drain system under the installed sink to the drain hole 14 or drain holes 104 of the sink.

Referring now to FIGS. 1-9, and most specifically to FIGS. 1-5, accessory 10 is shown. Accessory 10 may be for holding undermount sink 12 with drain hole 14 against underside 16 of opening 18 of countertop 20, including, but not limited to granite countertop 94. Accessory 10 may generally include plank 22, cord 28, and block 34. Plank 22 may have first length 24 that is longer than opening width 26 of opening 18 in countertop 20. As such, plank 22 may be placed across opening width 26 of opening 18 in countertop 20 in a horizontal position, as shown in FIGS. 2, 4A, 4B, 6, 8, and 9. Cord 28 may have top end 30 and bottom end 32. Top end 30 of cord 28 may be attached to plank 22. Block 34 may be affixed to bottom end 32 of cord 28. Block 34 may be configured to be inserted into and secured under drain hole 14, as shown best in FIGS. 2, 3, 4A, 4B, 6, 7, 8 and 9. Block 34 may have second length 36 longer than drain width 38 of drain hole 14. As such, block 34 may be placed underneath drain hole 14 in a horizontal position, as shown in FIGS. 2, 3, 4A, 4B, 6, 7, 8 and 9. Block 34 may be configured for holding undermount sink 12 against underside 16 of opening 18 of countertop 20 through the attachment to plank 22 via cord 28. Whereby, when block 34 is positioned below drain hole 14 of undermount sink 12, in such a horizontal position across drain width 38 of drain hole 14 and plank 22 is positioned across opening width 26 of opening 18 in countertop 20, cord 28 may be configured to extend from plank 22 to block 34, whereby accessory 10 may be configured to support and/or hold undermount sink 12 against underside 16 of opening 18 of countertop 20.

Figure 6:
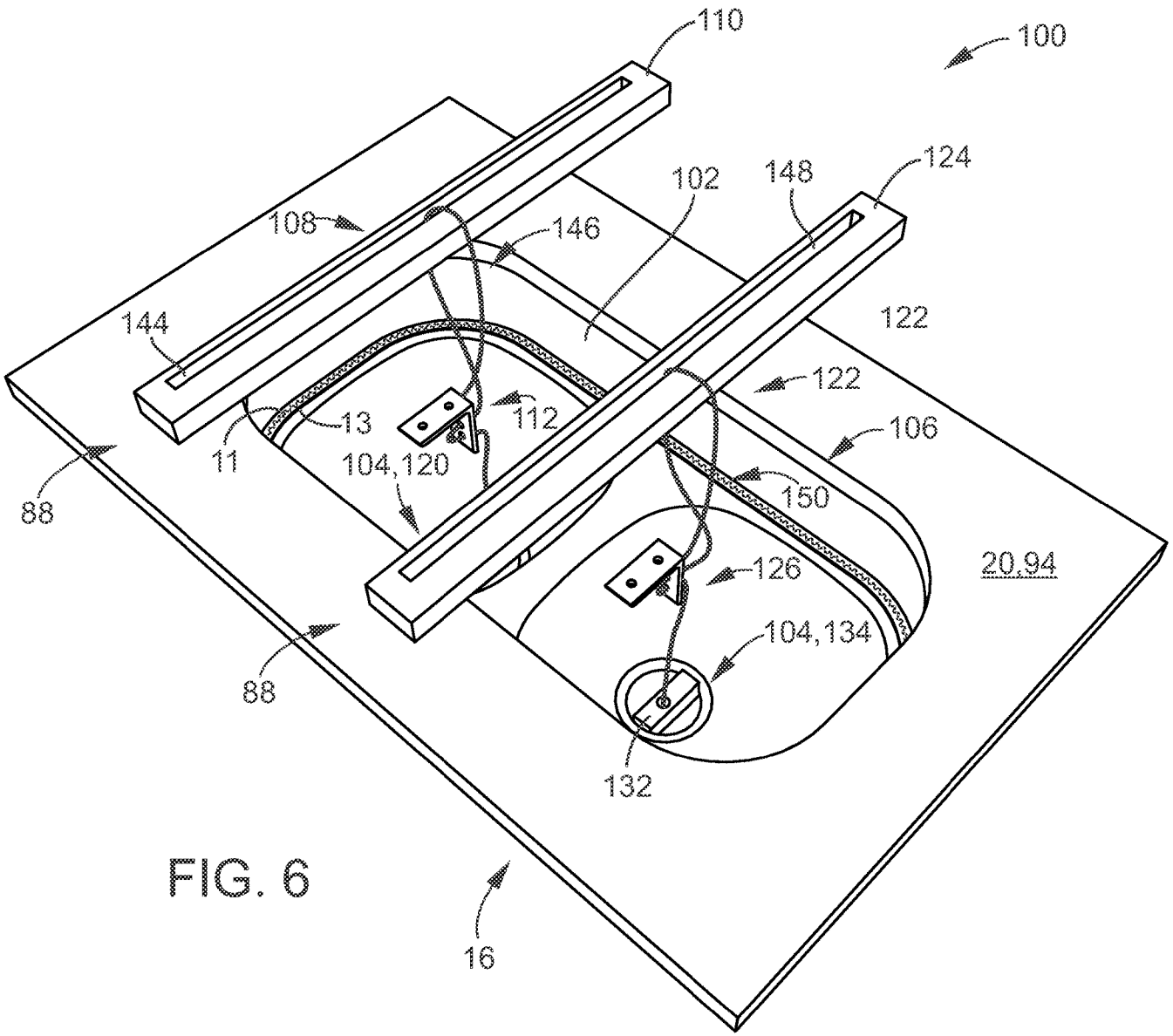
FIG. 6 is a top perspective environmental view of the system with two (2) accessories for holding an undermount sink against an underside of an opening of a countertop from FIG. 5 being used to hold a double undermount sink in position on the underside of an opening of a double opening of a countertop.
Figure 7:
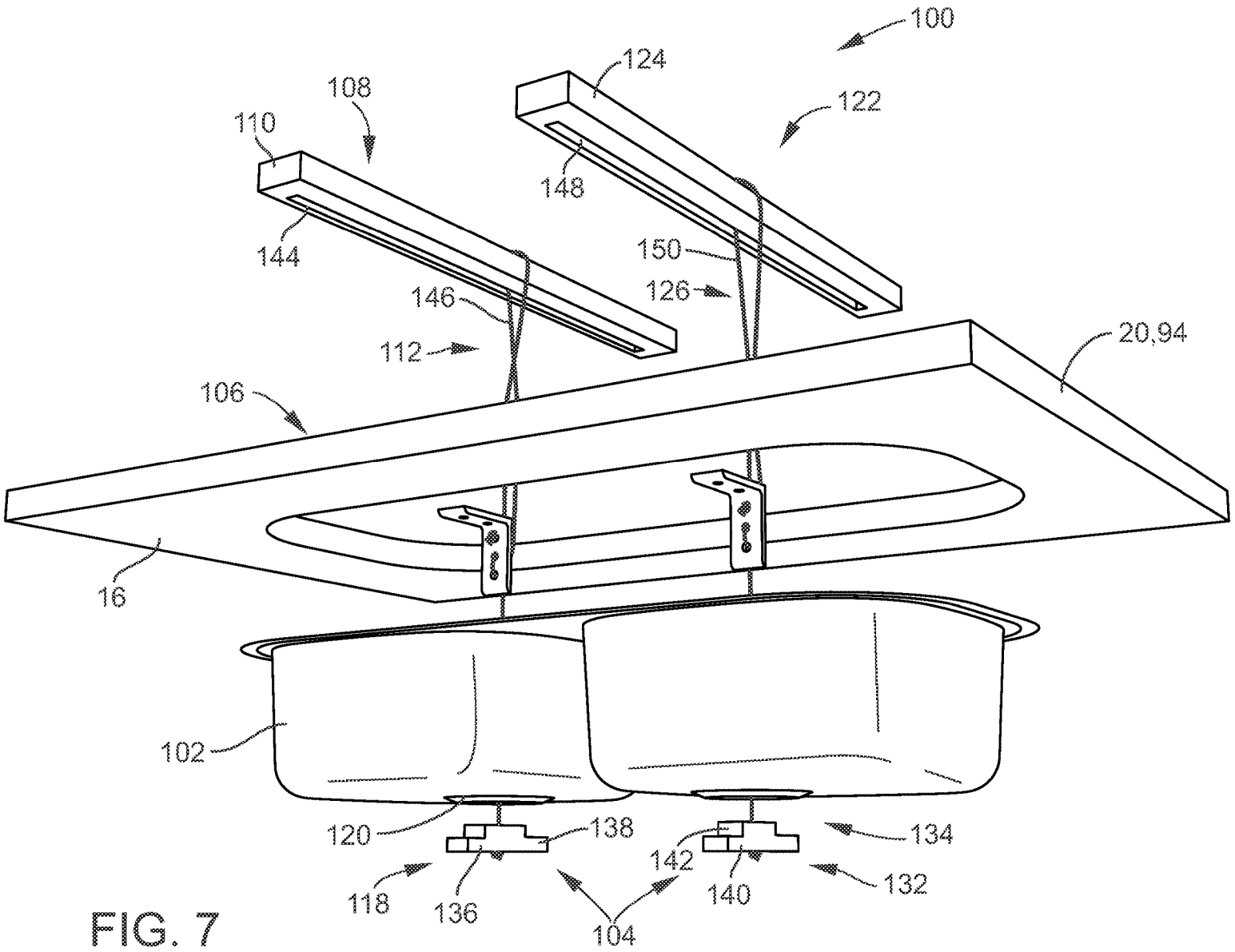
FIG. 7 is a side perspective environmental view of the system with two (2) accessories for holding an undermount sink against an underside of an opening of a countertop from FIG. 5 being installed to hold a double undermount sink in position on the underside of an opening of a double opening of a countertop.
Figure 8:
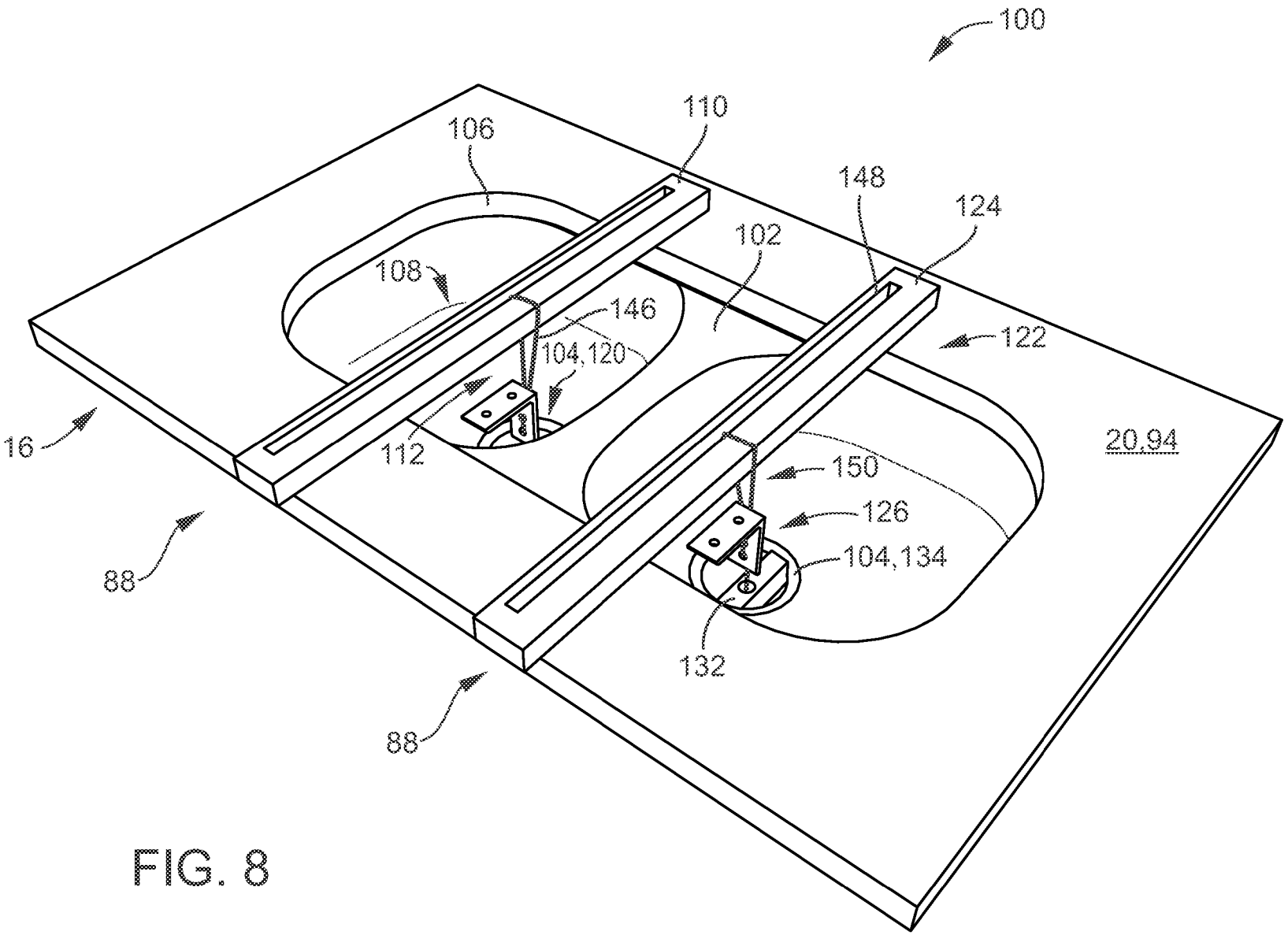
FIG. 8 is a top perspective environmental view of the system with two (2) accessories for holding an undermount sink against an underside of an opening of a countertop of FIG. 1 being used to hold the double undermount sink in position on the underside of a double opening of a countertop with the plank in an initial position horizontally.
Figure 9:
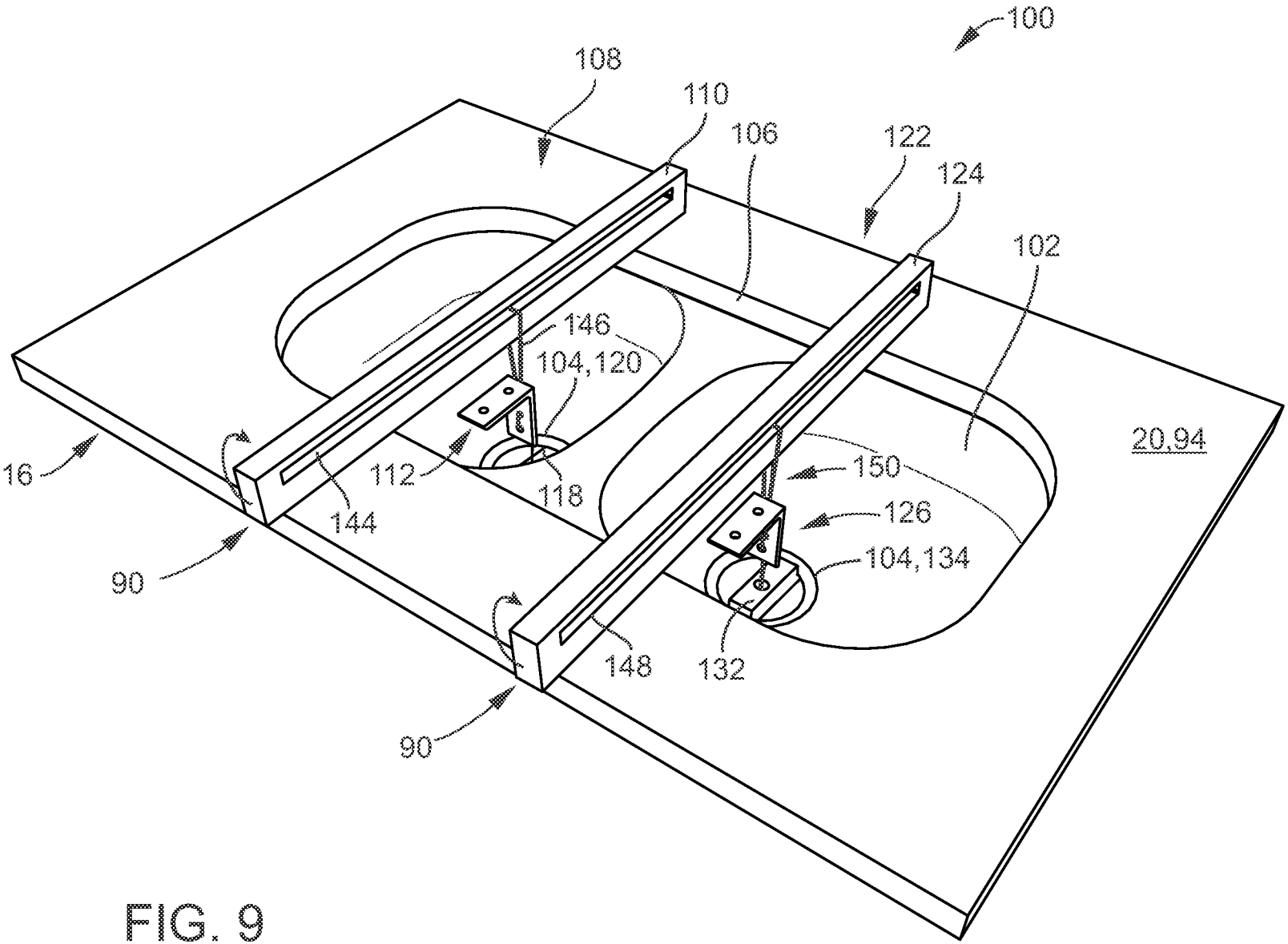
FIG. 9 is a top perspective environmental view of the system with two (2) accessories for holding an undermount sink against an underside of an opening of a countertop of FIG. 1 being used to hold the double undermount sink in position on the underside of a double opening of a countertop with the plank rotated in position vertically to create tension.

Cord 28 may be included with accessory 10. Cord 28 may be for connecting plank 22 resting on countertop 20 across opening 18 and block 34 underneath and across drain hole 14. cord 28 may be any device, mechanism, or method for connecting plank 22 resting on countertop 20 across opening 18 and block 34 underneath and across drain hole 14, including, but not limited to, any strings, ropes, chains, bands, tapes, cords, bars, the like, and or combinations thereof. One feature of accessory 10 may be that cord 28 can have adjustable length 40. Adjustable length 40 of cord 28 may be configured for allowing accessory 10 to be used with various sizes, shapes, or configurations of undermount sink 12. Adjustable length 40 of cord 28 may also be configured for lengthening to allow for plank 22 to be positioned across opening width 26 of opening 18 of countertop 20 and to allow block 34 to be positioned below drain hole 14 across drain width 38 of drain hole 14. Whereby, once plank 22 and block 34 are in such a position (as best shown in FIG. 6) cord 28 may be configured to shorten for tensioning cord 28 between plank 22 positioned across opening 18 of countertop 20 and block 34 positioned below drain hole 14 across drain width 38 of drain hole 14. Adjustable length 40 of cord 28 may be adjustable by any means, mechanism, method, and/or combination thereof. In select embodiments, adjustable length 40 of cord 28 may include adjustment mechanism 42 configured for adjusting adjustable length 40 of cord 28. Adjustment mechanism 42 may include any adjustment type of mechanism for cord 28, including but not limited to, slip coupling 44 configured to allow adjustable length 40 of cord 28 to be adjusted and secured in length.

Referring specifically to adjustment mechanism 42 shown in FIGS. 1-9, in select embodiments of accessory 10 for holding undermount sink 12 with drain hole 14 against underside 16 of opening 18 of countertop 20, adjustment mechanism 42 for cord 28 may include L-shaped bracket 46. L-shaped bracket 46 may have vertical portion 48 and horizontal portion 50. Vertical portion 48 may include at least three holes 52 therethrough. Three holes 52 through vertical portion 48 may include first hole 54, second hole 58 and third hole 60. First hole 54 may be configured to hold first end 56 of cord 28. Second hole 58 may be below first hole 54 and may be configured to receive cord 28 therethrough. Third hole 60 may be below second hole 58 and may be configured to receive cord 28 therethrough. Wherein, cord 28 may be secured to first hole 54 at first end 56 via first knot 62, wrap around plank 22 in adjustable loop 64 and go through second hole 58 in one direction, back through third hole 60 in another direction, and be secured to block 34 at second end 70. Wherein, L-shaped bracket 46 may be moved up and down on cord 28 through second hole 58 and third hole 60. Whereby, adjustable loop 64 around plank 22 may be increased and decreased for shortening and lengthening adjustable length 40 of cord 28, respectively. Horizontal portion 50 of L-shaped bracket 46 may be configured for manipulating L-shaped bracket 46 to move up and down on cord 28. Wherein, L-shaped bracket 46 may be locked into position on cord 28 when tensioned via cord 28 going through second hole 58 in the one direction and back through third hole 60 in the another direction, thereby locking adjustable length 40 of cord 28.

As best shown in FIGS. 1, 4A, 4B, and 5, in select embodiments of accessory 10 for holding undermount sink 12 with drain hole 14 against underside 16 of opening 18 of countertop 20, block 34 may include block hole 72 therethrough configured to receive second end 70 of cord 28. Whereby, second knot 74 may be tied below block 34 for securing second end 70 of cord 28 to block 34.

As best shown in FIGS. 1, 3, 4A, 4B, 5 and 7, another feature of accessory 10 for holding undermount sink 12 with drain hole 14 against underside 16 of opening 18 of countertop 20 may be that block 34 can include bottom portion 76 and top portion 80. Bottom portion 76 may have bottom length 78. Bottom length 78 may be second length 36 that is longer than drain width 38 of drain hole 14. As such, bottom portion 76 may be positioned on the bottom of drain hole 14 and extend horizontally across drain width 38 without being pulled into drain hole 14. Top portion 80 may have top length 82. Top length 82 may be shorter than drain width 38 of drain hole 14. Wherein, block 34 may be configured to securely hold undermount sink 12 via drain hole 14 by inserting top portion 80 inside drain width 38 of drain hole 14, where bottom portion 76 extends across drain width 38 of drain hole 14, whereby top portion 80 positioned inside drain width 38 of drain hole 14 may be configured to maintain the position of bottom portion 76 across drain width 38 of drain hole 14.

Referring now specifically to FIGS. 1, 2, 4A, 4B, 5, 6, 8 and 9) another feature of accessory 10 for holding undermount sink 12 with drain hole 14 against underside 16 of opening 18 of countertop 20 may be that plank 22 can include height 84 and width 86. Width 86 may be larger or longer than height 84. Wherein, plank 22 may be configured to tension cord 28 for securely holding undermount sink 12 in position under opening 18 in countertop 20 by rotating plank 22 from first position 88 (see FIGS. 1, 2, 4A, 5, 6, and 8) where height 84 is vertical to second tensioned position 90 (see FIGS. 4B and 9) where width 86 is vertical.

Referring now to FIGS. 1-2 and 4-9, another feature of accessory 10 for holding undermount sink 12 with drain hole 14 against underside 16 of opening 18 of countertop 20 may be that plank 22 can include slot 92. Slot 92 may run lengthwise therethrough plank 22. Wherein, cord 28 may be wrapped around plank 22 through slot 92 to create adjustable loop 64. Whereby, slot 92 may be configured to maintain adjustable loop 64 on plank 22 while allowing adjustable loop 64 to move lengthwise along plank 22 for proper positioning over drain hole 14 of undermount sink 12.

Referring to FIGS. 1-9, another feature of accessory 10 for holding undermount sink 12 with drain hole 14 against underside 16 of opening 18 of countertop 20 may be that accessory 10 can be used on any type of countertop 20, including, but not limited to granite countertop 94, or the like.

Referring now specifically to FIGS. 5-9, in another aspect, the instant disclosure embraces accessory system 100 for holding double undermount sink 102 with two drain holes 104 against underside 16 of double sized opening 106 of countertop 20. In general, accessory system 100 may include two or more of accessories 10 for holding undermount sink 12 with drain hole 14 against underside 16 of opening 18 of countertop 20 in any of the various embodiments and/or combination of embodiments shown and/or described herein. Accordingly, accessory system 100 may include first accessory 108 and second accessory 122. First accessory 108 may include first plank 110, first cord 112, and first block 118. First plank 110 may have first length 24 longer than opening width 26 of double sized opening 106 in countertop 20. First cord 112 may have first top end 114 and first bottom end 116. First top end 114 of first cord 112 may be attached to first plank 110. First block 118 may be affixed to first bottom end 116 of first cord 112. First block 118 may be configured to be inserted into and secured under the one drain hole 120 of two drain holes 104. First block 118 may have second length 36 longer than drain width 38 of the one drain hole 120 of the two drain holes 104. Second accessory 122 may include second plank 124, second cord 126, and second block 132. Second plank 124 may have first length 24 longer than opening width 26 of double sized opening 106 in countertop 20. Second cord 126 may have second top end 128 and second bottom end 130. Second top end 128 of second cord 126 may be attached to second plank 124. Second block 132 may be affixed to second bottom end 130 of second cord 126. Second block 132 may be configured to be inserted into and secured under another drain 134 of the two drain holes 104. Second block 132 may have second length 36 longer than drain width 38 of another drain hole 134 of the two drain holes 104. Wherein, first block 118 and second block 132 may be configured for holding double undermount sink 102 against underside 16 of double sized opening 106 of countertop 20 through attachments to first plank 110 via first cord 112 and second plank 124 via second cord 126. Whereby, when first block 118 is positioned below the one drain hole 120 of the two drain holes 104 of double undermount sink 102 across drain width 38 of the one drain hole 120 of the two drain holes 104 and first plank 110 is positioned across opening width 26 of the double sized opening 106 in countertop 20, first cord 112 may be configured to extend from first plank 110 to first block 118. Likewise, when second block 132 is positioned below the another drain hole 134 of the two drain holes 104 of the double undermount sink 102 across drain width 38 of the another drain hole 134 of the two drain holes 104 and second plank 124 is positioned across opening width 26 of the double sized opening 106 in countertop 20, second cord 126 may be configured to extend from second plank 124 to second block 132. Whereby, accessory system 100 may be configured to support double undermount sink 102 against underside 16 of double sized opening 106 of countertop 20 via the first accessory 108 and second accessory 122.

As shown in FIGS. 5-9, one feature of accessory system 100 for holding double undermount sink 102 with two drain holes 104 against underside 16 of double sized opening 106 of countertop 20 may be that first cord 112 and second cord 126 may have adjustable lengths 40. Adjustable lengths 40 of first cord 112 and second cord 126 may be configured for use with various sizes, shapes, or configurations of double undermount sink 102. Adjustable lengths 40 of first cord 112 and second cord 126 may also be configured for lengthening to allow for first plank 110 and second plank 124 to be positioned across opening width 26 of double sized opening 106 of countertop 20, and first block 118 to be positioned below one drain hole 120 of the two drain holes 104 across drain width 38 and second block 132 to be positioned below the another drain hole 134 of the two drain holes 104 across drain width 38. Whereby, first cord 112 and second cord 126 may be configured to shorten for tensioning first cord 112 and second cord 126 between first plank 110 and second plank 124 positioned across double sized opening 106 of countertop 20 and first block 118 and second block 132 positioned below the two drain holes 104. In select embodiments, adjustable length 40 of each of first cord 112 and second cord 126 may include adjustment mechanism 42 configured for adjusting adjustable length 40 of each of first cord 112 and second cord 126. Adjustment mechanism 42 of first cord 112 and second cord 126 may be any adjustment mechanism, including, but not limited to, any of the embodiments of adjustment mechanism 42 shown and/or described herein, including but not limited to, slip coupling 44 and/or L-shaped bracket 46.

As shown in FIGS. 5-9, one feature of accessory system 100 for holding double undermount sink 102 with two drain holes 104 against underside 16 of double sized opening 106 of countertop 20 may be that first block 118 can include first bottom portion 136 and first top portion 138. First bottom portion 136 may include bottom length 78, where bottom length 78 may be second length 36 that is longer than drain width 38 of two drain holes 104. First top portion 138 may have top length 82, where top length 82 is shorter than drain width 38 of the two drain holes 104. Wherein, first block 118 may be configured to securely hold double undermount sink 102 via the one drain hole 120 of the two drain holes 104 by inserting first top portion 138 inside drain width 38 of the one drain hole 120 of the two drain holes 104, where first bottom portion 136 extends across drain width 38 of the one drain hole 120 of the two drain holes 104. Whereby, first top portion 138 positioned inside drain width 38 of the one drain hole 120 of the two drain holes 104 may be configured to maintain the position of the first bottom portion 136 across drain width 38 of the one drain hole 120 of the two drain holes 104.

As shown in FIGS. 5-9, one feature of accessory system 100 for holding double undermount sink 102 with two drain holes 104 against underside 16 of double sized opening 106 of countertop 20 may be that second block 132 can include second bottom portion 140 and second top portion 142. Second bottom portion 140 may include bottom length 78, where bottom length 78 is second length 36 that is longer than drain width 38 of the two drain holes 104. Second top portion 142 may have top length 82, where top length 82 may be shorter than drain width 38 of the two drain holes 104. Wherein, second block 132 may be configured to securely hold double undermount sink 102 via the another drain hole 134 of the two drain holes 104 by inserting second top portion 142 inside drain width 38 of the another drain hole 134 of the two drain holes 104, where second bottom portion 140 extends across drain width 38 of the another drain hole 134 of the two drain holes 104. Whereby, second top portion 142 positioned inside drain width 38 of the another drain hole 134 of the two drain holes 104 may be configured to maintain the position of second bottom portion 140 across drain width 38 of the another drain hole 134 of the two drain holes 104.

As shown in FIGS. 5-9, one feature of accessory system 100 for holding double undermount sink 102 with two drain holes 104 against underside 16 of double sized opening 106 of countertop 20 may be that first plank 110 and second plank 124 can include height 84 and width 86. Width 86 of first plank 110 and second plank 124 may be larger than height 84. Wherein, first plank 110 and second plank 124 may be configured to tension first cord 112 and second cord 126, respectively, for securely holding double undermount sink 102 in position under double sized opening 106 in countertop 20 by rotating first plank 110 and second plank 124 from first position 88 (see FIG. 8) where height 84 is vertical to second tensioned position 90 (see FIG. 9) where width 86 is vertical.

As shown in FIGS. 5-9, one feature of accessory system 100 for holding double undermount sink 102 with two drain holes 104 against underside 16 of double sized opening 106 of countertop 20 may be that first plank 110 can include first slot 144. First slot 144 may run lengthwise therethrough first plank 110. Wherein, first cord 112 may be wrapped around first plank 110 through first slot 144 to create first adjustable loop 146. Wherein, first slot 144 may be configured to maintain first adjustable loop 146 on first plank 110 while allowing first adjustable loop 146 to move lengthwise along first plank 110 for proper positioning over the one drain hole 120 of the two drain holes 104 of the double undermount sink 102.

As shown in FIGS. 5-9, one feature of accessory system 100 for holding double undermount sink 102 with two drain holes 104 against underside 16 of double sized opening 106 of countertop 20 may be that second plank 124 can include second slot 148. Second slot 148 may run lengthwise therethrough second plank 124. Wherein, second cord 126 may be wrapped around second plank 124 through second slot 148 to create second adjustable loop 150. Wherein, second slot 148 may be configured to maintain second adjustable loop 150 on second plank 124 while allowing second adjustable loop 150 to move lengthwise along second plank 124 for proper positioning over the another drain hole 134 of the two drain holes 104 of the double undermount sink 102.

Figure 10:
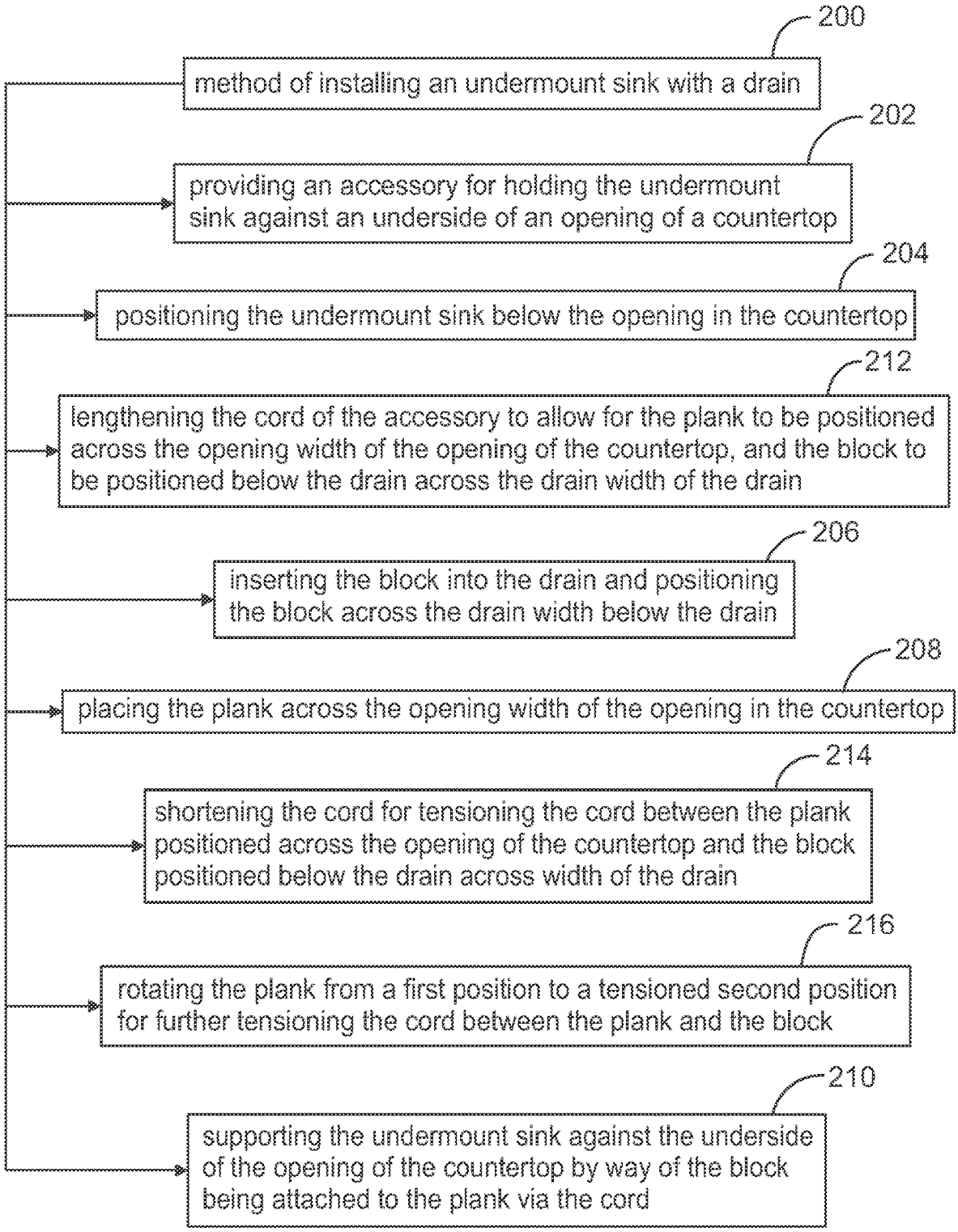
FIG. 10 is a flow chart of a method for holding an undermount sink against an underside of an opening in a countertop according to select embodiments of the instant disclosure.

Referring now to FIG. 10, in another aspect, the instant disclosure embraces method 200 of installing undermount sink 12 (or double undermount sink 102) with drain hole 14 (or two drain holes 104). Method 200 of installing undermount sink 12 (or double undermount sink 102) with drain hole 14 (or two drain holes 104) may generally include utilizing accessory 10 (or accessory system 100) for holding undermount sink 12 with drain hole 14 against underside 16 of opening 18 of countertop 20 in any of the embodiments and/or combination of embodiments shown and/or described herein. As such, method 200 of installing undermount sink 12 (or double undermount sink 102) with drain hole 14 (or two drain holes 104) may include step 202 of providing at least one accessory 10 for holding the undermount sink 12 against underside 16 of opening 18 of countertop 20 in any of the embodiments and/or combination of embodiments shown and/or described herein. With the provided accessory 10 or accessories 10, method 200 may further include the steps of: step 204 of positioning undermount sink 12 below opening 18 in countertop 20; step 206 of inserting block 34 into drain hole 14 and positioning block 34 across drain width 38 below drain hole 14; step 208 of placing plank 22 across opening width 26 of opening 18 in countertop 20; and step 210 of supporting (or holding) undermount sink 12 against underside 16 of opening 18 of countertop 20 by way of block 34 being attached to plank 22 via cord 28. In select embodiments of method 200 of installing undermount sink 12 (or double undermount sink 102) with drain hole 14 (or two drain holes 104), when cord 28 has adjustable length 40, method 200 may further include the steps of: prior to step 206 of inserting block 34 into drain hole 14, step 212 of lengthening cord 28 to allow for plank 22 to be positioned across opening width 26 of opening 18 of countertop 20, and block 34 to be positioned below drain hole 14 across drain width 38 of drain hole 14; after plank 22 is placed across opening width 26 of opening 18 of countertop 20, step 214 of shortening cord 28 for tensioning cord 28 between plank 22 positioned across opening 18 of countertop 20 and block 34 positioned below drain hole 14 across width 38 of drain hole 14; and step 216 of rotating plank 22 from first position 88 to tensioned second position 90 for further tensioning cord 28 between plank 22 and block 34.

In sum, the disclosed accessory 10, accessory system 100 and/or method 200 may be designed to save time and allow for more efficient use of work time in installing sinks, including, but not limited to, undermount sink 12 and double undermount sink 102.

In use, to use accessory 10 (accessory system 100) for lifting and securely holding undermount sink 12 (or double undermount sink 102) against underside 16 of granite countertop 94, or the like, an individual would first place the wooden, plastic, or like material, plank 22 flat across opening 18 on top of granite countertop 94 and apply a bead of silicone sealant 11 along the top edge or perimeter 13 of undermount sink 12 to be installed. See FIG. 6. He would then position the sink basin under opening 18 in countertop 20, loosen or lengthen cord 28, and pass block 34 at second end 70 of cord 28 through drain hole 14 on the sink basin (like undermount sink 12 or double undermount sink 102). The installer would then position block 34 across the underside of the sink's drain hole 14 and shorten or tighten cord 28 to raise sink 12 upward until it was positioned securely and firmly under the perimeter of countertop opening 18. He would then flip plank 22 into a vertical position (second tensioned position 88) on its thin edge (height 84) to further tighten cord 28 and create additional tension. This would further pull sink 12 upward and press silicone sealant 11 on its perimeter 13 against underside 16 of countertop 20. Optionally, the installer could then further secure sink 12 to countertop 20 using undermount brackets and let the silicone sealant 11 dry for 24 hours. After 24 hours had passed, the installer could turn plank 22 downward into a horizontal position (first position 88), loosen cord 28, remove block 34 from drain hole 14 and remove plank 22 from countertop 20.

Of course, the two accessories 10 for lifting and securely holding undermount sink 12 against underside 16 of granite countertop 94 could be used when installing dual basin sink 102, as shown with accessory system 100. Used in this manner, accessories 10 (first accessory 108 and second accessory 122) for lifting and securely holding undermount sink 12 against underside 16 of granite countertop 94 could make quick work of installing double undermount sink 102 within double sized opening 106 of granite countertop 94. It could eliminate the need for one person to hold the double sink 102 while another secured it in place using an assemblage of 2×4 planks and a wood clamp. Thus, the job could be performed by one person and with little stress and strain on the back and arms. Using accessory 10 and/or accessory system 100 could also eliminate the need for professional installers to return to a job site to retrieve a clamp left to hold a sink basin in place for 24 hours while the silicone sealant 11 dried.

Accessory 10 for lifting and securely holding undermount sink 12 against underside 16 of granite countertop 94 may be developed to fulfill the need for quick and easy installation of undermount sink 12 or double undermount sink 102, or the like, on granite countertop 94, or the like. The appealing features of the disclosed accessory 10, accessory system 100, and/or method 200 for lifting and securely holding undermount sink 12 or double undermount sink 102, or the like against the underside 16 of granite countertop 94, or the like, would be its ease of use, time- and effort-savings, efficiency, convenience, affordability, and ability to enhance comfort and safety when installing undermount sink 12 or double undermount sink 102, or the like.

The disclosed accessory 10, accessory system 100, and/or method 200 for lifting and securely holding undermount sink 12 or double undermount sink 102, or the like, against the underside 16 of granite countertop 94, or the like, would provide a useful accessory for individuals who install undermount sinks. Accessory 10, accessory system 100, and/or method 200 could provide a simple, yet effective means of raising a sink basin against underside 16 of granite countertop 94, or the like, and holding the sink in place as an individual further secured the sink basin with metal clips. Indeed, accessory 10, accessory system 100, and/or method 200 could allow a single individual to lift and secure the sink basin in place and thus allow him to perform the task without the assistance of another individual. This could enhance convenience for the do-it-yourself enthusiast and would reduce man-hours and labor costs among professional plumbers, builders, contractors, etc.

Furthermore, accessory 10, accessory system 100, and/or method 200 for lifting and securely holding undermount sink 12 or double undermount sink 102, or the like, against underside 16 of granite countertop 94, or the like, may eliminate the need for a person to manually lift and hold a sink basin underneath a countertop during the installation process. This could reduce stress and strain on the back, arms, and shoulders, which would enhance comfort. It might also prevent injures, which would enhance safety.

In addition, accessory 10, accessory system 100, and/or method 200 for lifting and securely holding undermount sink 12 or double undermount sink 102, or the like, against underside 16 of granite countertop 94, or the like, could be inexpensive to manufacture. Thus, plumbers and contractors who install undermount sinks could simply leave the unit at a jobsite after a sink was installed. Indeed, the cost associated with purchasing the unit could be included in the price of installation and the assembly could simply be discarded after use. This would provide a convenient alternative to using wood clamps to hold an undermount sink in place, as professional installers would not have to return to a job site to retrieve such clamps that had been left overnight. Again, this would reduce labor costs and would allow plumbers and contractors to make more efficient and productive use of work time. Of course, accessory 10 or accessory system 100 could also be retrieved and reused if so desired.

Ultimately, accessory 10, accessory system 100, and/or method 200 for lifting and securely holding undermount sink 12 or double undermount sink 102, or the like, against underside 16 of granite countertop 94, or the like, could be easy to use, time- and effort-saving, efficient, cost-effective, inexpensive to manufacture and purchase, comfort-enhancing, safety-enhancing, and durable.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. An accessory for holding an undermount sink with a drain hole against an underside of an opening of a countertop comprising:

a plank with a first length longer than an opening width of the opening in the countertop;

a cord with a top end and a bottom end, the top end of the cord is attached to the plank; and a block affixed to the bottom end of the cord, the block is configured to be inserted into and secured under the drain hole, the block has a second length longer than a drain width of the drain hole;

the accessory is configured for holding the undermount sink against the underside of the opening of the countertop through the cord being attached between the plank and the block.

2. The accessory of claim 1, wherein, when the block is positioned below the drain hole of the undermount sink across the drain width of the drain hole and the plank is positioned across the opening width of the opening in the countertop, the cord is configured to extend from the plank to the block, whereby the accessory is configured to support the undermount sink against the underside of the opening of the countertop.

3. The accessory of claim 1, wherein the cord has an adjustable length, the adjustable length of the cord is configured for use with various sizes, shapes, or configurations of the undermount sink.

4. The accessory of claim 3, wherein the adjustable length of the cord is configured for lengthening to allow for the plank to be positioned across the opening width of the opening of the countertop and the block to be positioned below the drain hole across the drain width of the drain hole, whereby, the cord is configured to shorten for tensioning the cord between the plank positioned across the opening of the countertop and the block positioned below the drain hole across the drain width of the drain hole.

5. The accessory of claim 3, wherein the adjustable length of the cord including an adjustment mechanism configured for adjusting the adjustable length of the cord.

6. The accessory of claim 5, wherein the adjustment mechanism including a slip coupling configured to allow the adjustable length of the cord to be adjusted and secured in length.

7. The accessory of claim 5, wherein the adjustment mechanism including:

an L-shaped bracket with a vertical portion and a horizontal portion;

the vertical portion including least three holes therethrough, the three holes through the vertical portion including:

a first hole configured to hold a first end of the cord;

a second hole below the first hole configured to receive the cord therethrough; and a third hole below the second hole configured to receive the cord therethrough;

the cord is secured to the first hole at the first end via a first knot, wrap around the plank in an adjustable loop and go through the second hole in one direction, back through the third hole in another direction, and be secured to the block at a second end;

wherein, the L-shaped bracket is configured to move up and down on the cord through the second hole and the third hole, whereby the adjustable loop around the plank is increased and decreased for shortening and lengthening the cord, respectively.

8. The accessory of claim 7, wherein the horizontal portion of the L-shaped bracket is configured for manipulating the L-shaped bracket to move up and down on the cord.

9. The accessory of claim 7, wherein the L-shaped bracket is locked into position on the cord when tensioned via the cord going through the second hole in the one direction and back through the third hole in the another direction, thereby locking the adjustable length of the cord.

10. The accessory of claim 1, wherein the block including a block hole therethrough configured to receive a second end of the cord, whereby a second knot is tied below the block for securing the second end of the cord to the block.

11. The accessory of claim 1, wherein the block including:

a bottom portion with a bottom length, the bottom length is the second length that is longer than the drain width of the drain hole; and a top portion with a top length, the top length is shorter than the drain width of the drain hole;

wherein, the block is configured to securely hold the undermount sink via the drain hole by inserting the top portion inside the drain width of the drain hole, where the bottom portion extends across the drain width of the drain hole, whereby the top portion positioned inside the drain width of the drain hole is configured to maintain the bottom portion positioned across the drain width of the drain hole.

12. The accessory of claim 1, wherein the plank including:

a height; and a width larger than the height;

wherein, the plank is configured to tension the cord for securely holding the undermount sink in position under the opening in the countertop by rotating the plank from a first position where the height is vertical to a second tensioned position where the width is vertical.

13. The accessory of claim 1, wherein the plank including a slot running lengthwise therethrough.

14. The accessory of claim 13, wherein the cord is wrapped around the plank through the slot to create an adjustable loop, wherein the slot is configured to maintain the adjustable loop on the plank while allowing the adjustable loop to move lengthwise along the plank for proper positioning over the drain hole of the undermount sink.

15. The accessory of claim 1, wherein the countertop is a granite countertop.

16. An accessory system for holding a double undermount sink with two drain holes against an underside of a double sized opening of a countertop comprising:

a first accessory comprising:

a first plank with a first length longer than an opening width of the double sized opening in the countertop;

a first cord with a first top end and a first bottom end, the first top end of the first cord is attached to the first plank; and a first block affixed to the first bottom end of the first cord, the first block is configured to be inserted into and secured under a one drain hole of the two drain holes, the first block has a second length longer than a drain width of the two drain holes; and a second accessory comprising:

a second plank with the first length longer than the opening width of the double sized opening in the countertop;

a second cord with a second top end and a second bottom end, the second top end of the second cord is attached to the second plank; and a second block affixed to the second bottom end of the second cord, the second block is configured to be inserted into and secured under an another drain hole of the two drain holes, the second block has the second length longer than the drain width of the two drain holes;

wherein, the accessory system is configured for holding the double undermount sink against the underside of the double sized opening of the countertop through the first cord being attached between the first plank and the first block and the second cord being attached between the second plank and the second block.

17. The accessory system of claim 16, wherein:

when the first block is positioned below the one drain hole of the two drain holes of the double undermount sink across the drain width of the one drain hole of the two drain holes and the first plank is positioned across the opening width of the double sized opening in the countertop, the first cord is configured to extend from the first plank to the first block; and when the second block is positioned below the another drain hole of the two drain holes of the double undermount sink across the drain width of the another drain hole of the two drain holes and the second plank is positioned across the opening width of the double sized opening in the countertop, the second cord is configured to extend from the second plank to the second block;

whereby, the accessory system is configured to support the double undermount sink against the underside of the double sized opening of the countertop via the first accessory and the second accessory.

18. The accessory system of claim 16, wherein:

the first cord and the second cord have adjustable lengths, the adjustable lengths of the first cord and the second cord are configured for use with various sizes, shapes, or configurations of the double undermount sink, and the adjustable lengths of the first cord and the second cord are configured for lengthening to allow for the first plank and the second plank to be positioned across the opening width of the double sized opening of the countertop, and the first block to be positioned below the one drain hole of the two drain holes across the drain width and the second block to be positioned below the another drain hole of the two drain holes across the drain width, whereby, the first cord and the second cord are configured to shorten for tensioning the first cord and the second cord between the first plank and the second plank positioned across the double sized opening of the countertop and the first block and the second block positioned below the two drain holes, wherein the adjustable length of each of the first cord and the second cord including an adjustment mechanism configured for adjusting the adjustable length of each of the first cord and the second cord;

the first block including:

a first bottom portion with a bottom length, the bottom length is the second length that is longer than the drain width of the two drain holes; and a first top portion with a top length, the top length is shorter than the drain width of the two drain holes;

wherein, the first block is configured to securely hold the double undermount sink via the one drain hole of the two drain holes by inserting the first top portion inside the drain width of the one drain hole of the two drain holes, where the first bottom portion extends across the drain width of the one drain hole of the two drain holes, whereby the first top portion positioned inside the drain width of the one drain hole of the two drain holes is configured to maintain the first bottom portion positioned across the drain width of the one drain hole of the two drain holes;

the second block including:

a second bottom portion with the bottom length, the bottom length is the second length that is longer than the drain width of the two drain holes; and a second top portion with the top length, the top length is shorter than the drain width of the two drain holes;

wherein, the second block is configured to securely hold the double undermount sink via the another drain hole of the two drain holes by inserting the second top portion inside the drain width of the another drain hole of the two drain holes, where the second bottom portion extends across the drain width of the another drain hole of the two drain holes, whereby the second top portion positioned inside the drain width of the another drain hole of the two drain holes is configured to maintain the second bottom portion positioned across the drain width of the another drain hole of the two drain holes;

the first plank and the second plank including:

a height; and a width larger than the height;

wherein, the first plank and the second plank are configured to tension the first cord and the second cord, respectively, for securely holding the double undermount sink in position under the double sized opening in the countertop by rotating the first plank and the second plank from a first position where the height is vertical to a second tensioned position where the width is vertical;

the first plank including a first slot running lengthwise therethrough, wherein the first cord is wrapped around the first plank through the first slot to create a first adjustable loop, wherein the first slot is configured to maintain the first adjustable loop on the first plank while allowing the first adjustable loop to move lengthwise along the first plank for proper positioning over the one drain hole of the two drain holes of the double undermount sink; and the second plank including a second slot running lengthwise therethrough, wherein the second cord is wrapped around the second plank through the second slot to create a second adjustable loop, wherein the second slot is configured to maintain the second adjustable loop on the second plank while allowing the second adjustable loop to move lengthwise along the second plank for proper positioning over the another drain hole of the two drain holes of the double undermount sink.

19. A method of installing an undermount sink with a drain hole comprising:

providing an accessory for holding the undermount sink against an underside of an opening of a countertop comprising:

a plank with a first length longer than an opening width of the opening in the countertop;

a cord with a top end and a bottom end, the top end of the cord is attached to the plank;

a block affixed to the bottom end of the cord, the block is configured to be inserted into and secured under the drain hole, the block has a second length longer than a drain width of the drain hole;

positioning the undermount sink below the opening in the countertop;

inserting the block into the drain hole and positioning the block across the drain width below the drain hole;

placing the plank across the opening width of the opening in the countertop; and supporting the undermount sink against the underside of the opening of the countertop by way of the cord being attached between the plank and the block.

20. The method of claim 19, wherein the cord has an adjustable length, wherein the method further including:

prior to inserting the block into the drain hole, lengthening the cord to allow for the plank to be positioned across the opening width of the opening of the countertop, and the block to be positioned below the drain hole across the drain width of the drain hole;

after the plank is placed across the opening width of the opening of the countertop, shortening the cord for tensioning the cord between the plank positioned across the opening of the countertop and the block positioned below the drain hole across the drain width of the drain hole; and rotating the plank from a first position to a tensioned second position for further tensioning the cord between the plank and the block.

* * * * *